US006803724B2

(12) United States Patent
Choi et al.

(10) Patent No.: US 6,803,724 B2
(45) Date of Patent: Oct. 12, 2004

(54) ELECTRODELESS LAMP AND LAMP BULB THEREFOR

(75) Inventors: Joon-Sik Choi, Seoul (KR); Yong-Seog Jeon, Gwangmyeong (KR); Hyo-Sik Jeon, Gwangmyeong (KR); Hyun-Jung Kim, Seoul (KR); Ji-Young Lee, Gwangmyeong (KR); Byeong-Ju Park, Seoul (KR)

(73) Assignee: LG Electronics, Inc., Seoul (KR)

( * ) Notice: Subject to any disclaimer, the term of this patent is extended or adjusted under 35 U.S.C. 154(b) by 57 days.

(21) Appl. No.: 10/213,079

(22) Filed: Aug. 7, 2002

(65) Prior Publication Data

US 2003/0193290 A1 Oct. 16, 2003

(30) Foreign Application Priority Data

Apr. 10, 2002 (KR) ..... 2002-19534

(51) Int. Cl.[7] ..... H01J 1/62

(52) U.S. Cl. ..... 313/643; 313/161; 313/572; 313/568; 315/248; 315/344

(58) Field of Search ..... 313/568, 643, 313/161, 572, 576, 484, 637; 315/344, 248

(56) References Cited

U.S. PATENT DOCUMENTS 4,972,120 A * 11/1990 Witting ..... 313/638
5,834,895 A * 11/1998 Dolan et al. ..... 313/570
6,084,348 A 7/2000 Love
6,734,630 B1 * 5/2004 Choi et al. ..... 313/638

* cited by examiner

*Primary Examiner*—Ashok Patel
(74) *Attorney, Agent, or Firm*—Birch, Stewart, Kolasch & Birch, LLP

(57) ABSTRACT

A bulb for an electrodeless lamp comprises: an envelope through which the light can be permeated; a filled material filled in the envelope for emitting the light as being excited by high frequency energy; and buffer gas, wherein the buffer gas comprises first buffer gas, and second buffer gas having a partial pressure less than 1% of the partial pressure of the first buffer gas in order to reduce a discharging voltage and lighting time, and thereby, the re-lighting after putting out the light can be performed easily and the re-lighting time is reduced to improve the convenience of the user and the reliability of electrodeless lamp.

10 Claims, 1 Drawing Sheet

ELECTRODELESS LAMP AND LAMP BULB THEREFOR

BACKGROUND OF THE INVENTION

1. Field of the Invention

The present invention relates to an electrodeless lamp, and particularly, to a lamp bulb for an electrodeless lamp in which a discharge material for forming plasma therein is filled.

2. Description of the Background Art

Generally, an electrodeless lamp is an apparatus for emitting light by exciting discharge material filled in an electrodeless bulb to form plasma.

FIG. 1 is a block diagram showing a general electrodeless lamp.

As shown therein, a general electrodeless lamp comprises: a microwave generator 10 for generating microwave or radio frequency energy by being applied an outer electric power (not shown); a waveguide 20 connected to the microwave generator 10 for transmitting the microwave generated in the microwave generator 10; a resonating device 30 having an inner space for resonating the microwave transmitted through the waveguide 20 by making an outer wall thereof as a mesh structure; and a bulb 40 installed in the inner space of the resonating device 30 for emitting light as being excited by the microwave.

On the other hand, the bulb 40 comprises an envelope which is able to permeate the light, and filled material for forming plasma by the microwave to emit the light filled in the envelope with buffer gas comprising argon (Ar), etc.

Also, the bulb 40 is coupled to a rotational shaft 52 extended from a rotating motor 51 which is positioned on an outer side of the resonating device 30 so as to be rotated for cooling.

An operation of the general electrodeless lamp having above described structure will be described as follows.

When the electric source is applied, the microwave generator 10 generates microwave, and the microwave transmitted to the resonating device 30 through the waveguide 20 excites the filled material filled in the bulb 40 to form the plasma, and thereby the light is emitted.

At that time, the bulb 40 generates a lot of heat as forming the plasma therein, and the bulb 40 is cooled down by being rotated according to the operation of the rotating motor 51.

On the other hand, the electrodeless lamp comes to have different characteristics according to the filled material and the buffer gas which are filled in the bulb 40. Especially, a light emitting efficiency, an energy efficiency, initial lighting, re-lighting time, and stability are differentiated according to the buffer gas filled inside the bulb 40.

In addition, the general electrodeless lamp can be re-lighted only after a predetermined time (tens of seconds~few minutes) has passed when the light is put out. It is caused by that a pressure of neutral gas in the bulb is too high, and therefore sufficient mean free path of electron having the energy needed to discharge the plasma can not be ensured.

Therefore, in order to reduce the re-lighting time, a method such as blowing a strong wind directly to the bulb to reduce the pressure in the bulb has been tried. However, problems such as increasing of cost as an additional device is disposed, reliability of the additional device, utilization of the space around the bulb, and shielding the light from the bulb by a nozzle are generated.

On the other hand, according to U.S. Pat. No. 6,084,348 as one of conventional arts for reducing the re-lighting time of the electrodeless lamp, a first component which is a participle component emitting the light when the high frequency energy is excited, a second component selected from a group of Xe and Kr and assigned to have a predetermined partial pressure, and a third component selected from a group of Ar, Ne, and He, and assigned to have a predetermined partial pressure are included in the bulb of the electrodeless lamp, and the partial pressure of the second component is larger than that of the third component. The pressure of second component is in a range of 50~200 torr, and the pressure of third component is in a range of 5~20 torr.

In the electrodeless lamp shown in U.S. Pat. No. 6,084,348, the Xe, that is, the second component has relatively higher light emitting efficiency in the most preferred embodiment. However, according to experiments, the initial lighting or the re-lighting is difficult, and therefore, a large electric field, that is, high frequency energy is needed in initial lighting, and the re-lighting time may be increased or the re-lighting may not be made.

SUMMARY OF THE INVENTION

Therefore, an object of the present invention is to provide a bulb for an electrodeless lamp by which re-lighting after putting out light can be made easily, and re-lighting time can be reduced.

To achieve the object of the present invention, as embodied and broadly described herein, there is provided a bulb for an electrodeless lamp comprising: an envelope through which the light can be permeated; a filled material filled in the envelope for emitting the light as being excited by high frequency energy; and buffer gas, comprising first buffer gas, and second buffer gas having a partial pressure less than 1% of the partial pressure of the first buffer gas in order to reduce a discharging voltage and lighting time.

Also, there is provided a bulb for an electrodeless lamp comprising: an envelope through which the light can be permeated; a filled material filled in the envelope for emitting the light as being excited by high frequency energy; and buffer gas, wherein the buffer gas comprises first buffer gas selected from a group including Ne and Xe, and second buffer gas including Ar having a partial pressure less than 1% of the partial pressure of the first buffer gas in order to reduce a discharging voltage and lighting time.

Also, there is provided an electrodeless lamp comprising: a microwave generation unit for generating microwave; a waveguide unit coupled to the microwave generation unit for transmitting the microwave generated from the microwave generation unit; a resonance unit connected to the waveguide unit for resonating the microwave which is transmitted through the waveguide; and a bulb unit disposed in the resonance unit for emitting light as being excited by the microwave, wherein the bulb unit comprises: an envelope through which the light can be permeated; a filled material filled in the envelope for emitting the light as being excited by high frequency energy; and buffer gas, comprising first buffer gas, and second buffer gas having a partial pressure less than 1% of the partial pressure of the first buffer gas in order to reduce a discharging voltage and lighting time.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A bulb 40 used in an electrodeless lamp according to the present invention comprises: an envelope through which the light can be permeated; and filled material filled in the envelope for emitting light as being excited by high frequency energy and buffer gas, and the buffer gas comprises first buffer gas and second buffer gas.

The envelope is formed to be a spherical shape or to be a cylindrical shape, and is made of a material having high light transmittance and low dielectric loss such as quartz generally.

The filled material is a material which is able to emit the light required by the electrodeless lamp, and metal halide and the like can be used as the filled material. Generally, the filled material is existed as solid status in a room temperature, and existed as gas state having high vapor pressure at a predetermined temperature.

Ne is used as the first buffer gas, and Kr and Xe also can be used as the first buffer gas. In addition, it is desirable that a partial pressure of the first buffer gas is maintained to be 200 torr or less at the room temperature (about 25° C.).

The second buffer gas is a different gas from the first buffer gas. Ar can be used as the second buffer gas, and He, Ne, Kr, or Xe also can be used as the second buffer gas. Also, the partial pressure of the second buffer gas is maintained to be lower than 1% of the partial pressure of the first buffer gas, and it is desirable that the partial pressure of the second buffer gas is maintained around 1% of the partial pressure of the first buffer gas.

Another gas besides the first and second buffer gases may be additionally mixed in the buffer gas.

Hereinafter, an operation of the bulb in the electrodeless lamp according to the present invention will be described in detail as follows.

Figure 1:
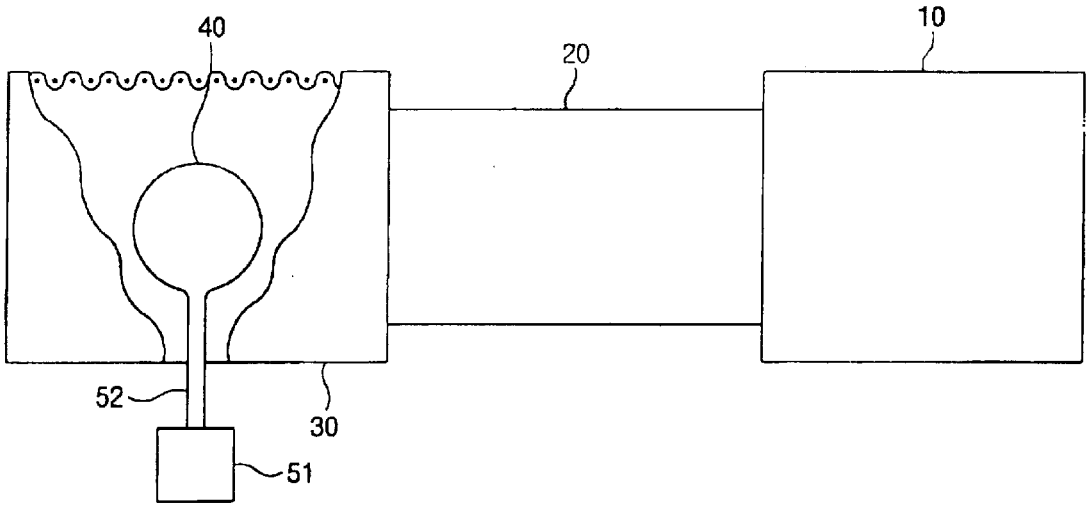
FIG. 1 is a block diagram showing a general electrodeless lamp.

The microwave is generated by the operation of the microwave generator 10 of the electrodeless lamp shown in FIG. 1, and the generated microwave is transmitted to the resonating device 30 through the waveguide 20. And the transmitted microwave excites the filled material and the buffer gas filled in the bulb 40 of the electrodeless lamp, and the plasma is formed to emit the light.

On the other hand, in order to form the plasma in the bulb of the electrodeless lamp, the voltage higher than a breakdown voltage should be applied. Therefore, when considering the energy efficiency, and the re-lighting time of the electrodeless lamp, the breakdown voltage for the initial starting should be lowered, and therefore, the buffer gas is filled in the bulb 40.

In the electrodeless lamp according to the present invention, and buffer gas in which the first buffer gas and the second buffer gas are mixed is filled in the bulb 40, and therefore, the re-lighting of the electrodeless lamp after putting out the lamp can be made easy and the re-lighting time is also reduced by the first and second buffer gases.

Table 1 is showing excitation voltages and ionization voltages of inert gases to be metastable states.

TABLE 1

| | He | Ne | Ar | Kr | Xe |
|---|---|---|---|---|---|
| Ionization voltage (V) | 24.5 | 21.5 | 15.7 | 14.0 | 12.1 |
| Excitation voltage (V) | 19.8<br>20.5 | 16.6<br>16.7 | 9.9<br>10.5 | 6.8<br>1.5 | 8.3<br>9.4 |

Figure 2:
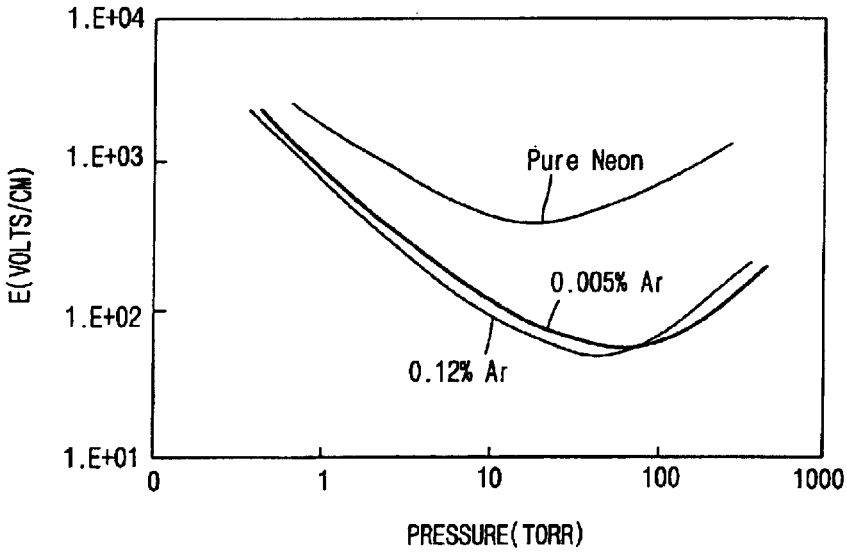
FIG. 2 is a graph showing a relation between pressure of buffer gas filled in a bulb of the electrodeless lamp and a starting voltage according to the present invention.

Especially, as shown in FIG. 2, according to experiment that Ne is the first buffer gas having the partial pressure lower than 200 torr at the room temperature (about 25° C.) and the Ar is the second buffer gas having 1% partial pressure of the first buffer gas, the starting voltage is greatly lower than that of the buffer gas including Ne only, and the re-lighting can be made stably in a short time.

It is because that the excitation voltage is around the ionization voltage of the second buffer gas including the Ar, and the atom in metastable state of Ne ionizes the atoms of the second buffer gas effectively, as shown in Table 1.

As described above, the starting for forming the plasma can be made easy by the buffer gas in which Ne gas, that is, the first buffer gas is mixed with a very small amount of the second buffer gas. In addition, the buffer gas is easily ionized by a small starting voltage, that is, a small electric field, then the gas excites the filled material which emits the light to form the plasma, and therefore, the re-lighting time can be reduced.

Also, the bulb of the electrodeless lamp is easily started in case that the buffer gas in which Ne and Kr are mixed is filled in the bulb, and the bulb can be started more easily in case that the buffer gas in which Ne and Ar are mixed is filled in the bulb, and therefore, the re-lighting time can be reduced more.

Also, according to the bulb of the electrodeless lamp of the present invention, the buffer gas including the Ne, Ar, Kr, and Xe is optimized to make the re-lighting easy and to reduce the re-lighting time. Therefore, an additional device is not needed, the structure of the lamp is simple and generation of additional cost is prevented.

Therefore, according to the bulb for electrodeless lamp of the present invention, the re-lighting after putting out the light can be performed easily and the re-lighting time is reduced, and therefore, the convenience of the user is improved and the reliability of electrodeless lamp is also improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A bulb for an electrodeless lamp comprising:

an envelope through which the light can be permeated;

a filled material filled in the envelope for emitting the light as being excited by high frequency energy; and buffer gas, wherein the buffer gas comprises first buffer gas, and second buffer gas having a partial pressure less than 1% of the partial pressure of the first buffer gas in order to reduce a discharging voltage and lighting time.

2. The bulb of claim 1, wherein the first buffer gas and the second buffer gas are selected respectively from a group including Ne, Ar, Kr, and Xe.

3. The bulb of claim 1, wherein a partial pressure of the first buffer gas is 200 torr or less.

4. A bulb for an electrodeless lamp comprising:

an envelope through which the light can be permeated;

a filled material filled in the envelope for emitting the light as being excited by high frequency energy; and buffer gas, wherein the buffer gas comprises first buffer gas selected from a group including Ne and Xe, and second buffer gas including Ar having a partial pressure less than 1% of the partial pressure of the, first buffer gas in order to reduce a discharging voltage and lighting time.

5. The bulb of claim 4, wherein a partial pressure of the first buffer gas is 200 torr or less.

6. An electrodeless lamp comprising:

a microwave generation unit for generating microwave;

a waveguide unit coupled to the microwave generation unit for transmitting the microwave generated from the microwave generation unit;

a resonance unit connected to the waveguide unit for resonating the microwave which is transmitted through the waveguide; and a bulb unit disposed in the resonance unit for emitting light as being excited by the microwave, wherein the bulb unit comprises: an envelope through which the light can be permeated; a filled material filled in the envelope for emitting the light as being excited by high frequency energy; and buffer gas, comprising first buffer gas, and second buffer gas having a partial pressure less than 1% of the partial pressure of the first buffer gas in order to reduce a discharging voltage and lighting time.

7. The lamp of claim 6, wherein the first buffer gas and second buffer gas are selected respectively from a group including Ne, Ar, Kr, and Xe.

8. The lamp of claim 6, wherein a partial pressure of the first buffer gas is 200 torr or less.

9. The bulb of claim 1, wherein the first buffer gas is Ne and the second buffer gas is Ar.

10. The lamp of claim 6, wherein the first buffer gas is Ne and the second buffer gas is Ar.

* * * * *